US007500655B1

(12) United States Patent
Smith et al.

(10) Patent No.: US 7,500,655 B1
(45) Date of Patent: Mar. 10, 2009

(54) ADJUSTABLE GATE BRACKET APPARATUS AND SYSTEM

(76) Inventors: Frederick L. Smith, 5336 Guthrie Rd., Loganville, GA (US) 30052; Jimmy H. Smith, 5732 Port Dr., Buford, GA (US) 30518

( * ) Notice: Subject to any disclaimer, the term of this patent is extended or adjusted under 35 U.S.C. 154(b) by 0 days.

(21) Appl. No.: 10/920,917

(22) Filed: Aug. 18, 2004

(51) Int. Cl.
*E04H 17/14* (2006.01)

(52) U.S. Cl. ..... 256/67; 256/27; 256/60; 256/65.06; 256/73

(58) Field of Classification Search ..... 256/21, 256/22, 60, 67, 65.04, 73, 65.05, 65.06, 27; 49/501; 403/85, 87, 91, 96, 98, 103; 248/289.11, 248/291.1, 299.1, 288.11, 219.3, 220.1
See application file for complete search history.

(56) References Cited

U.S. PATENT DOCUMENTS

| | | | | | |
|---|---|---|---|---|---|
| 293,673 | A | * | 2/1884 | Rogers | 256/22 |
| 436,546 | A | | 9/1890 | Seng | |
| 550,528 | A | * | 11/1895 | Peters | 256/67 |
| 597,480 | A | | 1/1898 | Fellows | |
| 649,387 | A | | 5/1900 | Wright | |
| 687,320 | A | | 11/1901 | Kuersten | |
| 702,304 | A | | 6/1902 | Hulse et al. | |
| 857,642 | A | | 6/1907 | Lorenz | |
| 895,297 | A | * | 8/1908 | Peter | 256/22 |
| 977,634 | A | | 12/1910 | Klasing | |
| 1,009,727 | A | | 11/1911 | Duigan | |
| 1,091,233 | A | | 3/1914 | Mitchell | |
| 1,490,956 | A | | 4/1924 | Binder | |
| 1,529,969 | A | | 3/1925 | Turner | |
| 1,564,844 | A | | 12/1925 | Gardner | |
| 6,464,209 | B2 | * | 10/2002 | Meis et al. | 256/73 |
| 6,802,496 | B1 | * | 10/2004 | Preta | 256/65.04 |

OTHER PUBLICATIONS

Merriam-Webster OnLine dictionary. www.m-w.com, "planar". Nov. 27, 2007.*
Merriam-Webster OnLine Dictionary. www.m-w.com, definition of "perforation", Jun. 18, 2008.*

* cited by examiner

*Primary Examiner*—Michael P Ferguson
(74) *Attorney, Agent, or Firm*—Myers & Kaplan, LLC; Sandra M. Sovinski

(57) ABSTRACT

An adjustable gate bracket apparatus and system. The apparatus typically includes a front bracket portion and a rear bracket portion. The front bracket portion includes a generally first rectangular planar body pivotally connected to a second rectangular planar body integrally connected to a curved planar body. The rear bracket portion typically includes two rectangular planar bodies pivotally connected to each other at respective corners. The ends of uprights and rails are connected between the front and rear bracket portions and secured together with rivets, bolts or other suitable. An adjustable gate bracket is secured at each corner of the gate panel. The gate panel is then adjusted to a desired angular orientation on a hill or other contour. Once the desired configuration is attained, the front and rear portions are fixed so that they do not pivot and the gate retains its angular orientation.

13 Claims, 4 Drawing Sheets

ADJUSTABLE GATE BRACKET APPARATUS AND SYSTEM

BACKGROUND

I. Field of the Invention

The present invention relates generally to the field of fences and gates and more particularly to an adjustable gate bracket apparatus and system.

II. Description of the Related Art

Present fences typically utilize a series of panels connected together to create a continuous fence. The same panels are also typically used to create a gate for the fence. In order to create the gate, two parallel vertical uprights are connected perpendicular to two parallel horizontal rails using gate brackets, also known as gate kits or gate L's. Several pickets are connected to the gate panel parallel to the uprights. FIG. 1 illustrates a prior art gate 100. As described above, the gate 100 includes uprights 105, rails 110 and pickets 115. The gate 100 further includes the brackets 120 as described above. FIG. 2 illustrates an up close perspective view of the prior art gate bracket 120. The gate 100 as described above are square or rectangular because the gate kits provide ninety degree brackets 120. The gate bracket 120 typically includes two perpendicular members 121, 122 and often a support web 123. Several rivets or bolts connect through to a mirror bracket to provide connection of the uprights 15 and rails 110. When the fence is built on a contour such as a hill, the fence panels can typically be adjusted to match the contour of the hill. However, since the gates are fixed in a square or rectangle, the gate does not match the contour of the hill, leaving unsightly gaps and an unruly gate to open and close.

SUMMARY

In general, the invention features an adjustable gate bracket apparatus and system. The apparatus typically includes a front bracket portion and a rear bracket portion. The front bracket portion includes a generally first rectangular planar body. The front bracket portion further includes a second rectangular planar body integrally connected to a curved planar body. The curved planar body includes several holes having adjacent perforations. The first and second bodies are pivotally connected to each other at respective corners. The rear bracket portion typically includes two rectangular planar bodies pivotally connected to each other at respective corners. The front and rear bracket portions are connected to each other by securing the ends of an upright and a rail portion between the front and rear bracket portions. Rivets, bolts or other suitable connectors are used to make a secure connection of the front and rear portions. An adjustable gate bracket is secured at each corner of the gate panel. The gate panel is then adjusted to a desired angular orientation on a hill or other contour. Once the desired configuration is attained, rivets and bolts are then inserted though the corresponding hole on the curved planar body through the upright or rail and into the rear bracket portion. With the curved portion now fixed, the adjustable gate panel now retains the overall angular orientation.

In general, in one aspect, the invention features a gate bracket kit, including a front bracket portion having a first generally rectangular planar body pivotally connected to a second rectangular planar body integrally connected to a curved planar body, the curved planar body overlapping the first rectangular body and a rear gate portion including two rectangular planar bodies pivotally connected to each other at respective corners, wherein the front and rear gate portions are adapted to be placed in opposition and connected to each other through respective components of a gate.

In one implementation, the curved portion includes a plurality of connection holes.

In another implementation, the curved portion includes a series of perforations adjacent the connection holes.

In another implementation, the curved portion is adapted to be sized down by breaking off part of the curved portion at one or more of the perforations.

In another implementation, a connection hole on the rear portion is adapted to be aligned with a connection hole on the front portion on both the first body and the curved body.

In another aspect, the invention features a gate bracket system, including two gate uprights in a parallel arrangement, two gate rails in a parallel arrangement and forming a parallelogram with the gate uprights and a gate bracket at each corner of the parallelogram, the gate bracket having a front bracket portion having a first generally rectangular planar body pivotally connected to a second rectangular planar body integrally connected to a curved planar body, the curved planar body overlapping the first rectangular body and a rear gate portion including two rectangular planar bodies pivotally connected to each other at respective corners.

In one implementation, each bracket further comprises a connection device connected through the curved body and the first body of the front gate portion and the respective planar body of the rear gate portion arranged in opposition to the first body of the front gate portion.

In another implementation, the system further includes connection devices connecting the front and rear gate portions and the respective upright and rail.

In another implementation, the first and second bodies of the front portion and the bodies of the rear portion comprise lips partially wrapped around the respective upright and rail.

In still another aspect, the invention features a gate bracket apparatus, including a front bracket portion having a first generally rectangular planar body pivotally connected to a second rectangular planar body integrally connected to a curved planar body, the curved planar body overlapping and connected to the first rectangular body and a rear gate portion having a first rectangular planar body connected to the first planar body of the front portion and a second rectangular body connected to the second rectangular body of the front gate portion, the first and second rectangular bodies of the rear gate portion being pivotally connected to each other.

In one implementation, the apparatus further includes a gate component connected in between the first rectangular body of the front gate portion and the first rectangular body of the rear gate portion.

In another implementation, the gate component is at least one of an upright and a rail.

In another implementation, the apparatus further includes a gate component connected in between the second rectangular body of the front gate portion and the second rectangular body of the rear gate portion.

In another implementation, the gate component is at least one of an upright and a rail.

In another implementation, the first rectangular body of the front gate portion and the first rectangular body of the rear gate portion are generally parallel and the second rectangular body of the front gate portion and the second rectangular body of the rear gate portion are generally parallel.

In another implementation, the apparatus further includes a connection device connecting the first generally rectangular planar body of the front gate portion, the curved planar body and the first planar body of the rear gate portion.

One advantage of the invention is that the adjustable gate brackets can be used to match a gate to the contour of a hill.

Another advantage of the invention is that a gate equipped with the adjustable gate bracket is easily opened and closed on a contour.

Other objects, advantages and capabilities of the invention will become apparent from the following description taken in conjunction with the accompanying drawings showing the preferred embodiment of the invention.

DETAILED DESCRIPTION

Figure 1:
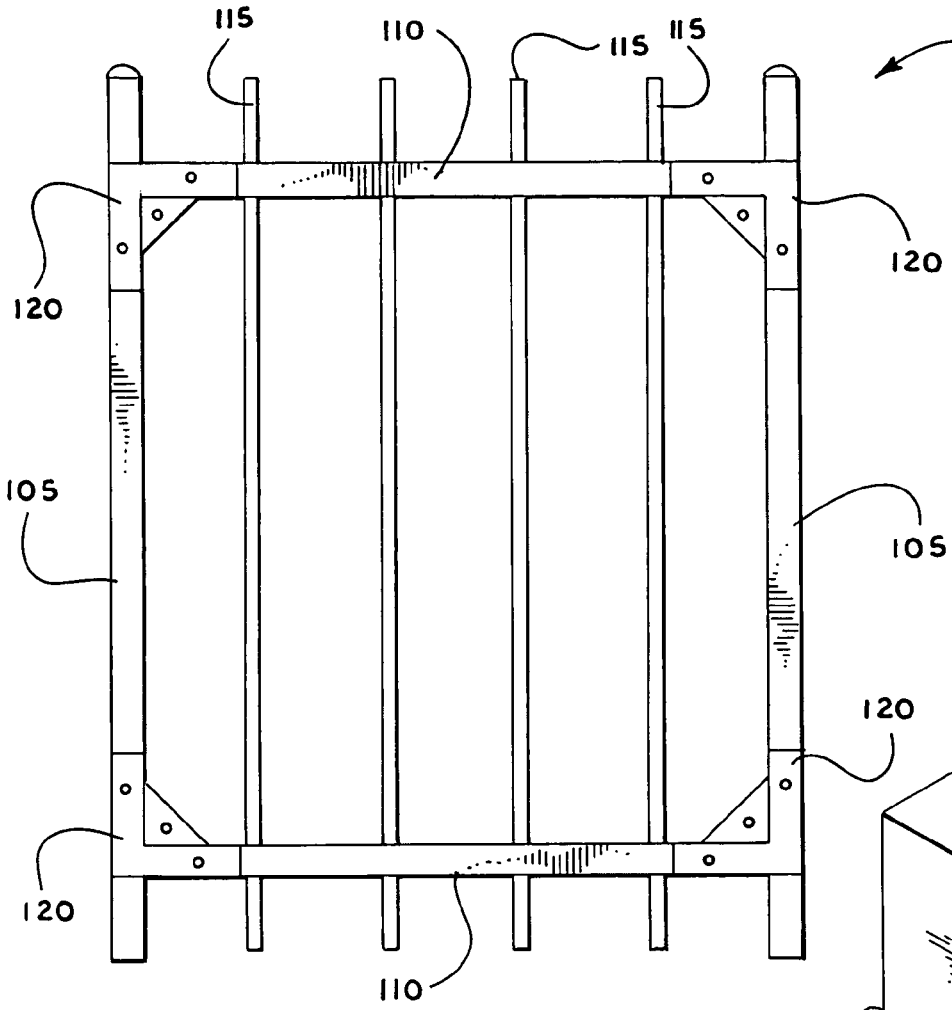
Fig 1 PRIOR ART
FIG. 1 illustrates a prior art gate.
Figure 2:
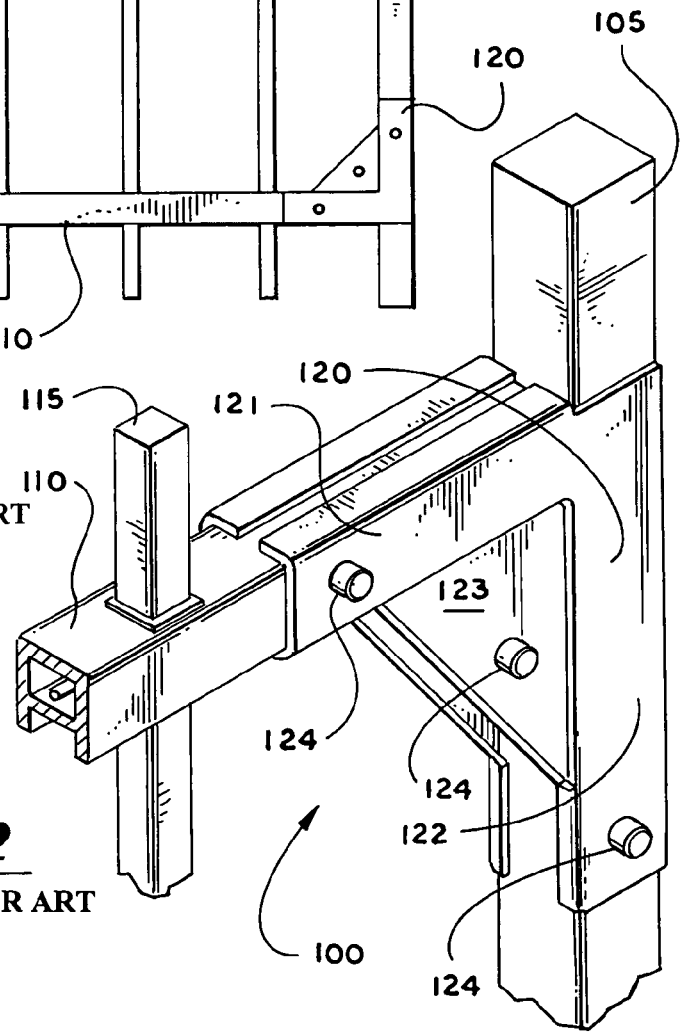
Fig 2 PRIOR ART
FIG. 2 illustrates a prior art gate bracket.
Figure 3A:
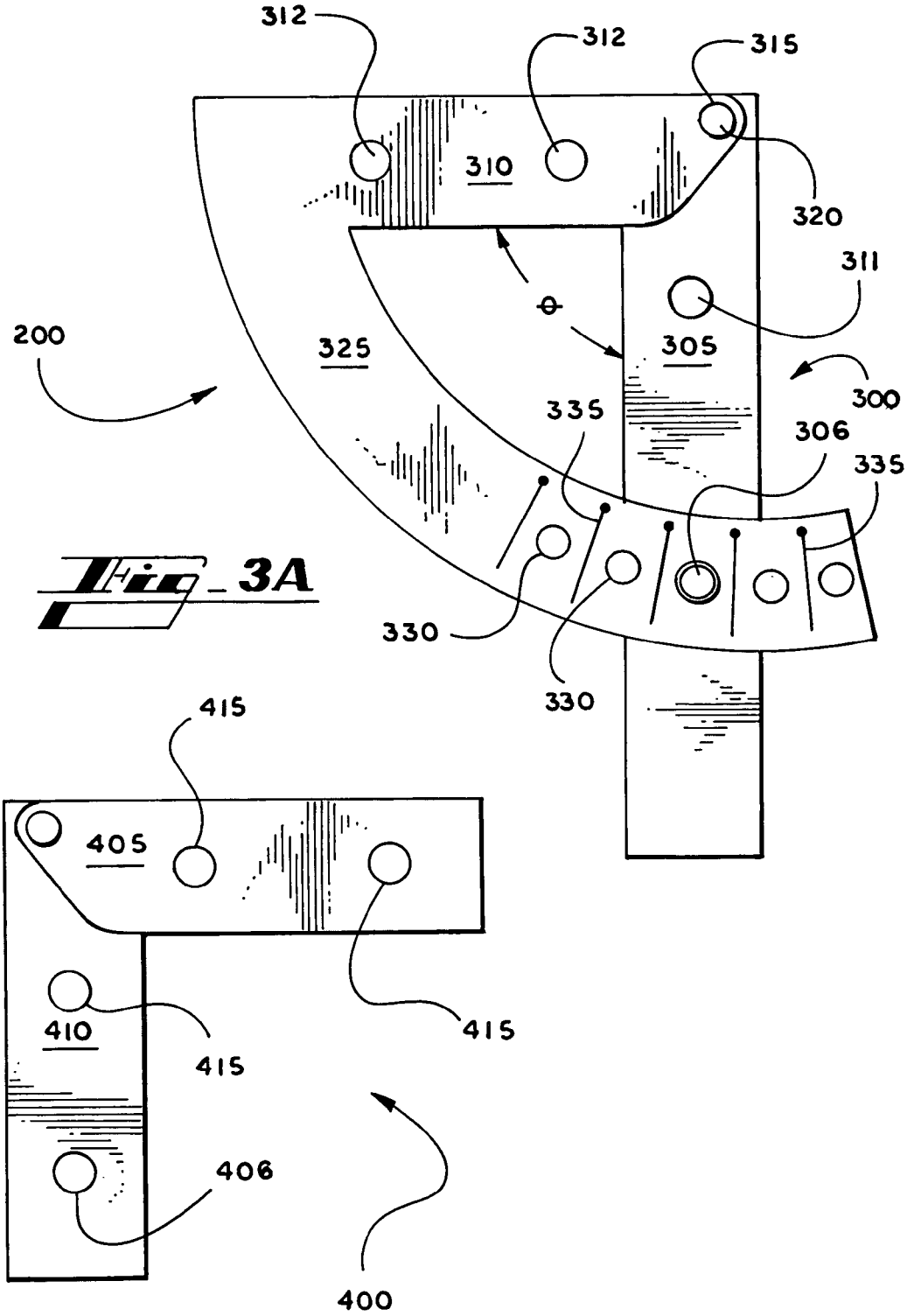
FIG. 3A illustrates an embodiment of an adjustable gate bracket apparatus.

Referring to the drawings wherein like reference numerals designate corresponding parts throughout the several figures, reference is made first to FIG. 3A that illustrates an embodiment of an adjustable gate bracket apparatus 200. The apparatus 200 includes a front bracket portion 300 and a rear bracket portion 400. The front portion 300 includes a first generally rectangular planar body 305 pivotally connected to a second rectangular planar body 310. The pivotal connection point 315 can be maintained by a variety of suitable connection devices 320 such as rivets. The connection point 315 allows the bodies 305, 310 to rotate about each other through a variety of angles represented by the angle θ. The second rectangular body 310 is integrally connected to a curved planar body 325, so that the second rectangular body 310 and the curved body 325 form a single integral piece sharing a common place of orientation. The curved planar body 325 overlaps the first rectangular body 305. Therefore, in a typical embodiment, the pivotal connection between the first and second bodies 305, 310 is such that the first body 305 is pivotally connected behind the second body 310. In this way, when the apparatus 200 is adjusted, the curved body 325 remains positioned in front of the first rectangular body 305. In general, the first body 305 includes a connection hole 311 for connection to gate components. The second body 310 also contains connection holes 312 for connection to the gate components.

In a typical embodiment, the curved portion 325 includes a plurality of connection holes 330. Furthermore, the first body 305 typically includes a connection hole 306 that is adapted to be aligned with one of the connection holes 330, as discussed further in the description below. In addition, the curved portion 325 typically includes a series of perforations 335 adjacent the connection holes 330, as also further discussed in the description below.

The apparatus 200 further includes the rear gate portion 400 that includes two rectangular planar bodies 405, 410 pivotally connected to each other at respective corners. Each of the planar bodies generally includes a series of connection holes 415 to allow the rear gate portion 400 to be connected to gate components as discussed further below. An additional connection hole 406 is adapted to be aligned in opposition to the connection hole 306 on the front gate portion 300 as well as one of the connection holes 330 on the curved body 325.

In general, the front and rear gate portions 300, 400 are adapted to be placed in opposition and connected to each other through respective components of a gate as now described with respect to the following figures.

Figures 3B, 4:
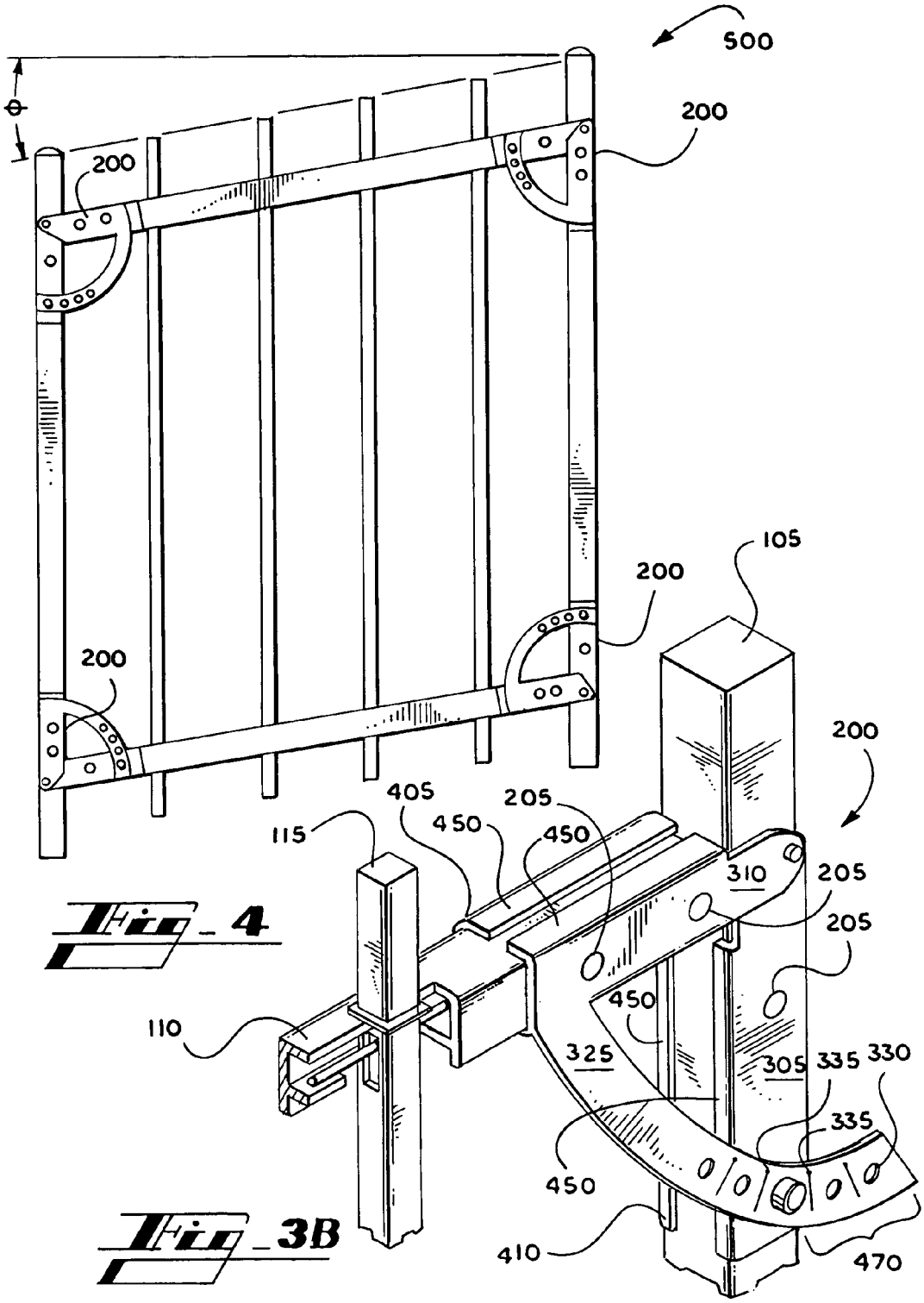
FIG. 3B illustrates an embodiment of an adjustable gate bracket.
FIG. 4 illustrates an embodiment of an adjustable gate.

FIG. 3B illustrates an embodiment of an adjustable gate bracket 200. The adjustable gate bracket 200 is connected to the components of a gate to create a gate that is adjustable to a contour. As described above, typical gate components include uprights 105, rails 110 and pickets 115. The gate bracket 200 is connected at a corner where an upright 105 and rail meet. As described above, the front and rear portions 300, 400 are aligned in opposition to each other. As a result, the first rectangular body 305 of the front gate portion 300 and the first rectangular body 410 of the rear gate portion 400 are generally parallel and the second rectangular body 310 of the front gate portion and the second rectangular body 4-5 of the rear gate portion 400 are generally parallel. In a typical implementation, suitable connection devices 205 such as rivets nuts and bolts and the like are inserted through the connection hole 311 of the first body 305 through the upright 105 and through the connection hole 415 on the planar body 410 on the rear gate portion 400. Similarly, connection devices 205 are inserted through the connection holes 312 on the second body 310 through the rail 110 and through the connection holes 415 of the body 405 of the rear gate portion 400. Lips 450 on all of the planar bodies 305, 310, 405, 410 keep the bodies 305, 310, 405, 410 partially wrapped around the respective upright and rail 105, 110 to prevent the bodies 305, 310, 405, 410 from rotating during the adjustment process. With the connection devices 205 in place, the curved body 325 can now freely move over the fixed body 305. In this orientation, the connection hole 306 on the body 305 is aligned with the connection hole 406 on the body 410. The user then adjusts the entire gate (see FIG. 4 immediately below) to achieve the desired angular orientation. During this adjustment process, the user aligns one of the connection holes 330 on the curved body 325 with the alignment holes 306, 406. When the desired alignment is achieved, a final connection device 460 is inserted through the chosen connection hole 330, which is in turn inserted through the connection hole 306, through the upright 105 and through the connection hole 406. The bracket is now fixed in the desired angular orientation and no rotation is now possible. Once the bracket 200 is connected in the desired angular orientation, a portion of the curved body 325 protrudes from the side of the upright 105. The excess is labeled as 470. The excess 470 can be easily removed by bending the curved body at one or more of the perforations 335. The perforations 335 thus allow an easy break of the excess 470 from the curved body so that no unnecessary edge protrudes from the gate.

FIG. 4 illustrates an embodiment of an adjustable gate 500. As shown in the figure, four adjustable gate brackets 200 are placed at the four corners of the fence 500. Each of the brackets 200 is connected to the gate 500 as described immediately above with respect to FIG. 3B. In general, the angular orientation of the gate 500 is the angle θ as formed by the adjusted gate bracket 200. In a typical embodiment, the gate brackets 200 can be made into mirror images, thus formed right and left handed brackets, for ease of connection as indicated by the two brackets 200 at the lower corners of the gate 500. The two upper corners of the gate 500 illustrate two brackets 200 of the same handedness. It is thus understood that in the discussion with respect to FIG. 3B, the terms upright 105 and rail 110 can be reversed since the bodies 305, 310, 405, 410 can thus be connected to either the upright 105 or the rail 105 depending on the corner of the fence where the bracket 200 is being connected or depending on the handedness of the bracket 200.

Figure 5:
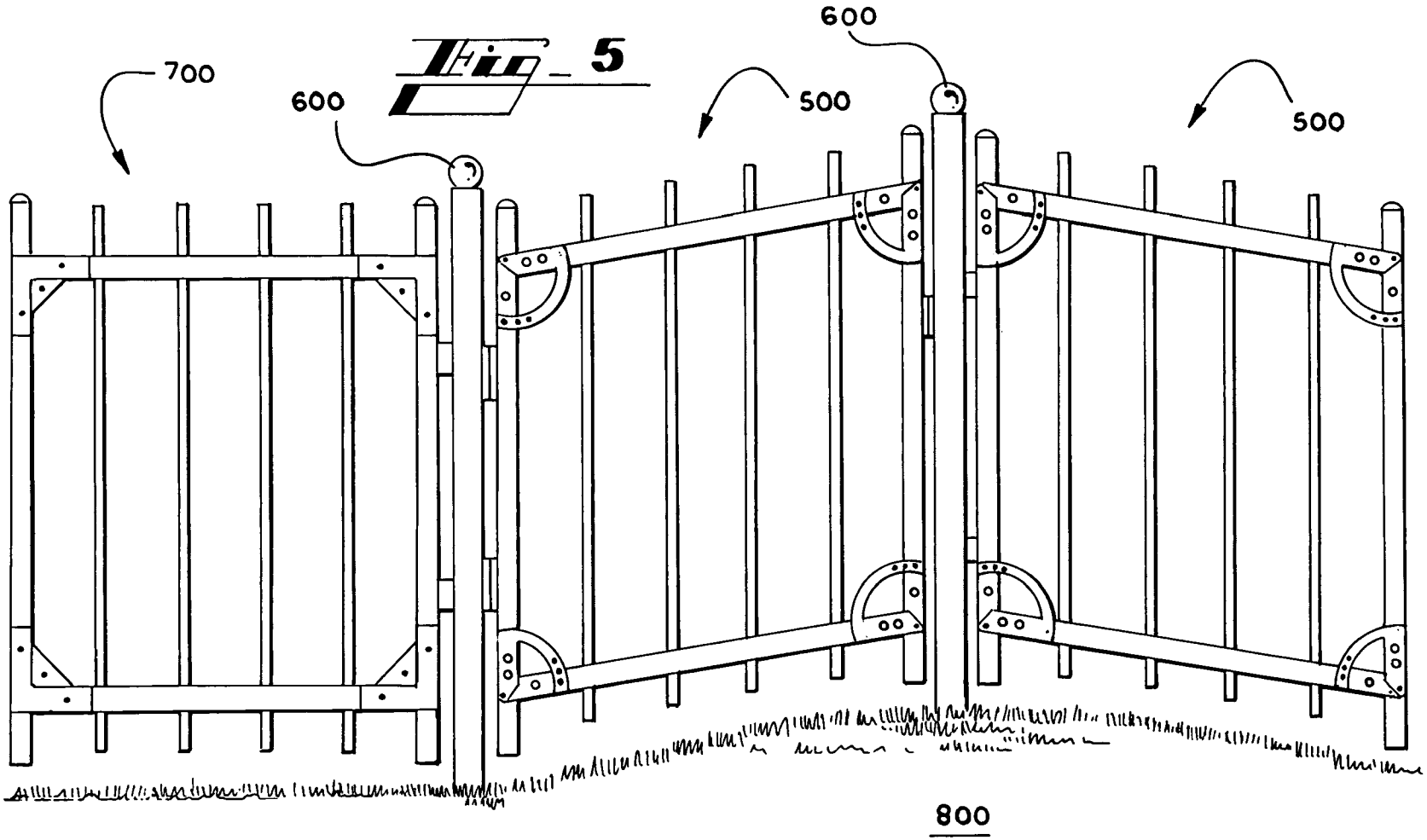
FIG. 5 illustrates an embodiment of a fence with adjustable gates.

FIG. 5 illustrates an embodiment of a fence 700 with adjustable gates 500. The figure illustrates an example of how several adjustable gates 500 having adjustable gate brackets 200. The gates 500 are connected to posts 600 on a contour 800 and are typically used in conjunction with prior art fence panels 100 where adjustable gates 500 are not required.

Since prior art gate brackets are often sold as bracket kits, the embodiments of the adjustable gate brackets can similarly be packaged and sold as adjustable gate bracket kits.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A gate bracket kit for use with at least one gate component to form a gate, said gate bracket kit comprising:

a front bracket having a first straight arm adapted for attachment to the front of a gate upright, said first straight arm having a proximal end, a distal end, and a pin receiving hole proximate said distal end of said first arm, a second straight arm adapted for attachment to the front of a gate rail, said second straight arm having a proximal end and a distal end, and an arcuate arm having a proximal end, a distal end, and a plurality of selectable pin receiving holes proximate said distal end of said arcuate arm, wherein said proximal end of said first straight arm of said front bracket is pivotally connected to said proximal end of said second straight arm of said front bracket, wherein said proximal end of said arcuate arm is integrally connected to said distal end of said second straight arm of said front bracket, and wherein said distal end of said arcuate arm overlaps said distal end of said first straight arm of said front bracket and extends from the front of the gate rail to the front of the gate upright, wherein an angle of said pivotal connection between said first straight arm and said second straight arm of said front bracket is defined according to a selection of one of said plurality of selectable pin receiving holes of said arcuate arm;

a rear bracket separate from said front bracket, said rear bracket having a first straight arm adapted for attachment to the rear of the gate upright, said first straight arm of the rear bracket having a proximal end, a distal end, and a pin receiving hole proximate said distal end of said first straight arm of the rear bracket, and a second straight arm adapted for attachment to the rear of the gate rail, said second straight arm of the rear bracket having a proximal end and a distal end, wherein said proximal end of said first straight arm of said rear bracket is pivotally connected to said proximal end of said second straight arm of said rear bracket; and a pin, wherein said front bracket and said rear bracket are adapted to be placed in opposition about the gate upright and the gate rail and securely engaged together by extension of said pin through said pin receiving hole of said first straight arm of said rear bracket, said pin receiving hole of said first straight arm of said front bracket, and one of said plurality of selectable pin receiving holes of said arcuate arm of said front bracket, and wherein an angle of said pivotal connection between said first straight arm and said second straight arm of said engaged rear bracket is essentially equivalent to said angle of said pivotal connection between said first straight arm and said second straight arm of said engaged front bracket.

2. The kit as claimed in claim 1, further comprising a plurality of connectors, wherein said first straight arm of said front bracket further comprises at least one connection hole for receiving one of said plurality of connectors for attaching said first straight arm of the front bracket to the gate upright, wherein said second straight arm of said front bracket further comprises at least one connection hole for receiving one of said plurality of connectors for attaching said second straight arm of the front bracket to the gate rail, wherein said first straight arm of said rear bracket further comprises at least one connection hole for receiving one of said plurality of connectors for attaching said first straight arm of said rear bracket to the gate upright, and wherein said second straight arm of said rear bracket further comprises at least one connection hole for receiving one of said plurality of connectors for attaching said second straight arm of said rear bracket to the gate rail.

3. The kit as claimed in claim 1, wherein said arcuate arm includes at least one perforation adjacent to at least one of said plurality of selectable pin receiving holes.

4. The kit as claimed in claim 3, wherein a length of said arcuate arm is reduced by breaking off a portion of said distal end of said arcuate arm proximate said at least one perforation.

5. The kit as claimed in claim 1, wherein at least one of said first straight arm and said second straight arm of said front bracket and said first straight arm and said second straight arm of said rear bracket further comprises lips adapted to extend at least partially around at least one component of a gate.

6. A gate bracket kit, comprising:

a front bracket having a first body having a first end and a second end, a second body having a first end and a second end, and a third body having a first end and a second end, wherein said first body is pivotally connected to said second body proximate said first end of said first body and proximate said first end of said second body, wherein said second body is integrally connected to said third body proximate said second end of said second body and proximate said first end of said third body, and wherein said third body overlaps said first body;

wherein said third body includes a plurality of selectable connection holes and at least one perforation adjacent to at least one of said plurality of connection holes, wherein an angle of said pivotal connection between said first body and said second body of said front bracket is defined according to a selection of one of said plurality of selectable connection holes of said third body, and wherein a length of said third body is reduced by breaking off a portion of said third body distal said at least one perforation; and a rear bracket including a first body having a first end and a second end, and a second body having a first end and a second end, wherein said first body of the rear bracket is pivotally connected to said second body of the rear bracket proximate said first end of said first body of the rear bracket and proximate said first end of said second body of the rear bracket, wherein said front bracket and rear bracket are adapted to be placed in opposition about a gate upright and a gate rail of a gate via a connector engaging said first body of said rear bracket and said first body and one of said plurality of selectable connection holes of said third body of said front bracket.

7. A gate system, comprising:

two gate uprights in a parallel arrangement;

two gate rails in a parallel arrangement and forming a parallelogram with said two gate uprights; and a gate bracket at each corner of said parallelogram, each said gate bracket comprising:

a front bracket having a first arm having a proximal end and a distal end, a second arm having a proximal end and a distal end, and a third arm having an arcuately-shaped length with a plurality of selectable apertures defined therethrough and along said length thereof, a proximal end and a distal end, wherein said proximal end of said first arm is pivotally connected to said proximal end of said second arm, wherein an angle of said pivotal connection between said first arm and said second arm of said front bracket is defined according to a selection of one of said plurality of selectable apertures of said third arm;

wherein said distal end of said second arm is integrally connected to said proximal end of said third arm, and wherein said distal end of said third arm overlaps said distal end of said first arm; and a rear bracket including a first arm having a proximal end and a distal end, and a second arm having a proximal end and a distal end, wherein said proximal end of said first arm of said rear bracket is pivotally connected to said proximal end of said second body arm of said rear bracket, wherein said front bracket and said rear bracket are adapted to be placed in opposition about one of said two gate uprights and one of said two gate rails, wherein said first arm of said front bracket and said first arm of said rear bracket are each adapted with at least one bracket-connecting aperture, and wherein a first bracket connector engages through said at least one bracket-connecting aperture in said distal end of said first arm of said rear bracket, through said at least one bracket-connecting aperture in said distal end of said first arm of said front bracket, and also through one of said plurality of apertures of said third arm of said front bracket to secure said front bracket and said rear bracket together through said one of said two gate uprights, wherein said second arm of said front bracket is adapted with at least one fence-connection aperture, wherein a first fence connector engages through said at least one fence-connection aperture to secure said front bracket to said one of said two gate rails, and wherein said second arm of said rear bracket is adapted with at least one fence-connection aperture, wherein a second fence connector engages through said at least one fence-connection aperture of said rear bracket to secure said rear bracket to said one of said two gate rails.

8. The system as claimed in claim 7, wherein said first arm and said second arm of said front bracket and said first arm and said second arm of said rear bracket each comprises lips adapted to partially wrap around respective ones of said two gate uprights and said two gate rails.

9. A variable angle gate bracket apparatus for use with at least one gate component to form a gate, said gate bracket apparatus, comprising:

a front bracket having a generally planar upright engagement member pivotally connected to and partially overlapping a generally planar crossrail engagement member, said generally planar crossrail engagement member integrally connected to an arcuate, planar bracket-angle adjustment member, said arcuate, planar bracket-angle adjustment member overlapping, selectably positioned relative to and connected to said generally planar upright engagement member, and coplanar with said generally planar crossrail engagement member, wherein said selectable position relative to said first generally planar upright engagement member defines said variable angle of said gate bracket; and a rear bracket having a generally planar upright engagement member connected to said generally planar upright engagement member of said front bracket and a generally planar crossrail engagement member connected to said generally planar crossrail engagement member of said front bracket by insertion of one or more locking pins through one or more respective bracket connection apertures defined in said front bracket and said rear bracket, said generally planar upright engagement member of said rear bracket and said generally planar crossrail engagement member of said rear bracket being partially overlapping and pivotally connected to each other;

wherein said arcuate, planar bracket-angle adjustment member further comprises a plurality of selectable locking pin receptacles, wherein insertion of a locking pin through one of said plurality of selectable locking pin receptacles secures said selectable position of said arcuate, planar bracket-angle adjustment member relative to said first generally planar upright engagement member of said front bracket and securely connects said front bracket and said rear bracket by passing through said bracket connection apertures in said front bracket and said rear bracket and said one of said plurality of selectable locking pin receptacles.

10. The apparatus as claimed in claim 9, further comprising a first gate component connected between said generally planar upright engagement member of said front bracket and said generally planar upright engagement member of said rear bracket, wherein said first gate component is a gate upright.

11. The apparatus as claimed in claim 10, further comprising a second gate component connected between said generally planar crossrail engagement member of said front bracket and said generally planar crossrail engagement member of said rear bracket, wherein said second gate component is a gate rail.

12. The apparatus as claimed in claim 9, wherein said generally planar upright engagement member of said front bracket and said generally planar upright engagement member of said rear bracket are disposed generally parallel, and wherein said generally planar crossrail engagement member of said front bracket and said generally planar crossrail engagement member of said rear bracket are disposed generally parallel.

13. The apparatus as claimed in claim 9, wherein at least one of said generally planar upright engagement member and said generally planar crossrail engagement member of said front bracket and said generally planar upright engagement member and said generally planar crossrail engagement member of said rear bracket further comprises lips adapted to extend at least partially around at least one component of a gate.

* * * * *